US006945174B2

(12) United States Patent
Aebi et al.

(10) Patent No.: US 6,945,174 B2
(45) Date of Patent: Sep. 20, 2005

(54) METHOD FOR CONNECTING IGNITORS IN AN IGNITION SYSTEM

(75) Inventors: Walter Aebi, Kyburg-Buchegg (CH); Jan Petzold, Rosrath (DE); Heinz Schafer, Liliethal (DE); Andreas Zemla, Troisdorf (DE)

(73) Assignees: Dynamit Nobel GmbH Explosivstoff-und Systemtechnik, Troisdorf (DE); Teltronik AG, Biberist (CH)

( * ) Notice: Subject to any disclaimer, the term of this patent is extended or adjusted under 35 U.S.C. 154(b) by 0 days.

(21) Appl. No.: 10/398,075

(22) PCT Filed: Sep. 28, 2001

(86) PCT No.: PCT/EP01/11275

§ 371 (c)(1),
(2), (4) Date: Oct. 22, 2003

(87) PCT Pub. No.: WO02/31431

PCT Pub. Date: Apr. 18, 2002

(65) Prior Publication Data

US 2004/0045470 A1 Mar. 11, 2004

(30) Foreign Application Priority Data

Sep. 30, 2000 (DE) ..... 100 48 707

(51) Int. Cl.[7] ..... F42D 1/55; F42C 13/04

(52) U.S. Cl. ..... 102/301; 102/217; 102/311; 102/200; 102/215

(58) Field of Search ..... 102/301, 217, 102/311, 215, 200; 89/27.12

(56) References Cited

U.S. PATENT DOCUMENTS 4,406,226 A * 9/1983 Davitt et al. ..... 102/311
4,489,655 A * 12/1984 Molnar ..... 102/217
4,610,203 A * 9/1986 Bock ..... 102/217
4,770,097 A * 9/1988 Wilson et al.
5,069,129 A * 12/1991 Kunitomo ..... 102/200
5,295,438 A * 3/1994 Hill et al. ..... 102/217
5,406,890 A * 4/1995 Marsh et al. ..... 102/217
5,714,712 A * 2/1998 Ewick et al. ..... 102/311
5,894,103 A * 4/1999 Shann ..... 102/217
6,644,202 B1 * 11/2003 Duniam et al. ..... 102/217

FOREIGN PATENT DOCUMENTS

| | | |
|---|---|---|
| DE | 199 45 790 A | 5/2000 |
| EP | 0 604 694 A | 7/1994 |
| EP | 0 897 098 A | 2/1999 |
| WO | WO-00 09967 A | 2/2000 |
| WO | WO-01 67031 A | 9/2001 |

* cited by examiner

*Primary Examiner*—Jack Kenu
*Assistant Examiner*—L. Semunegus
(74) *Attorney, Agent, or Firm*—Fulbright & Jaworski L.L.P.

(57) ABSTRACT

Errors may occur in a detonating system that consists of several detonating circuits when the connection—the logging-on—of detonators is effected to the buses of a logger which in turn is connected to a blaster. Connecting is effected, particularly in opencast-mining operations, under conditions that may lead to damage, not visible at first, in particular to the insulation of the detonators and also of the detonating lines. Errors may occur in the transmission of data, for example as a result of loss or falsification of the signals to be transmitted or as a result of intrusion of signals from an extraneous detonator.

In accordance with the invention it is therefore proposed that a log-on manager is installed which is in bidirectional contact with the loggers, with the blaster and with the log-data communicators of the loggers which signal the data pertaining to the detonators to the logger. The log-on manager coordinates the logging of the detonators on to the respective bus as well as the programming of the detonators and checks whether an error-free transmission of data is taking place.

13 Claims, 1 Drawing Sheet

METHOD FOR CONNECTING IGNITORS IN AN IGNITION SYSTEM

The invention relates to a method for connecting detonators to a detonating system, the method corresponding to the preamble to the first claim.

A detonating system consists of a plurality of detonators which are connected to a bus which in turn starts from a so-called logger. A logger is a device for reading and storing data, in which the relevant data pertaining to a detonator can be stored. A detonating system may consist of several detonating circuits: this means that several loggers are present, to each of which is connected a bus with a plurality of detonators. The loggers are in turn connected to a detonating device or a tripping apparatus, a so-called blaster, from which the detonators can be detonated in a predetermined temporal sequence on the basis of a detonation command. In addition to the transmission of signals, the buses that emanate from the loggers may also serve for supplying energy to the detonators, in particular for the purpose of charging the detonating capacitors. Detonating systems of this type are employed, for example, in the open-cast mining of mineral resources, of ores or coal, or in the pit-and-quarrying industry.

In order to be able to address the detonators individually with respect to their delay-time, detonators exist that have an identification code. This code may consist, for example, of an identification number or a bar code applied to the detonator externally and able to be read off. The identification code may also be stored in the electronics of the detonator. If this identification code is stored in the logger, the detonator can be addressed by the programming-and-storage electronics of the logger if a function, a delay-time for example, is to be stored in the detonator.

After the bus from the logger has been installed, the detonators, with their detonating line connected to the bus of the logger assigned to the, are logged on. If several loggers with appropriate buses are distributed in the terrain, logging-on of the detonators to the buses can be effected simultaneously. When a detonator is being connected to the bus, the person doing the connecting, the logger-on, communicates the identification code of the respective detonator to the logger assigned to the detonator, for example by radio. At the same time the logger-on can additionally communicate to the logger the geographical coordinates of the borehole into which the detonator is lowered. The coordinates of the borehole and also the identification code of the detonator can be combined into a so-called address, under which the respective detonator can be addressed individually from the logger. Determination of the coordinates of the borehole can be effected, for example, by means of GPS (Global Positioning System) or by means of the DGPS (Differential Global Positioning System).

Logging-on of the detonators to the bus is effected, particularly in opencast-mining operations, under conditions that may lead to damage which is not visible at first, in particular to the insulation of the detonators and also of the detonating lines. Such damage can lead to shunts, in particular a shunt from detonator to detonator. If these shunts arise between detonators that are simultaneously connected to different buses, errors in the transmission of data may occur, for example as a result of loss or falsification of the signals to be transmitted or as a result of intrusion of signals pertaining to an extraneous detonator.

The object of the present invention is to present a method with which the faults and errors that have been described can be avoided.

This object is accomplished with the aid of the characteristic features of the first claim. Advantageous configurations of the invention are claimed in the dependent claims.

In accordance with the invention it is proposed that a so-called log-on manager be installed. Each of the loggers-on carries a transceiver, a log-data communicator which has its own identification code and which serves for communicating the identification codes and the data pertaining to the geographical coordinates of the detonators to the logger assigned to it. These transceivers are designed for bidirectional contact both with the logger assigned to them in the given case and to the log-on manager. The log-on manager is in bidirectional contact with all the loggers and with all the log-data communicators which are carried by the loggers-on. Contact may be made via lines or by radio.

The method according to the invention for logging detonators on to the detonating circuit of a detonating system takes place as described here. A detonator is to be logged on to the bus of a logger by a logger-on. To this end, the logger-on who wishes to connect the detonator announces his presence by means of his log-data communicator to the log-on manager which recognises him from the identification code and can consequently assign the associated logger. Logging-on can be effected, for example by means of radio for example, by a signal with the identification code communicated to the log-on manager by virtue of a keystroke. The log-on manager acknowledges the log-on with a signal to the log-data communicator. If no other detonator is connected at the moment, an enabling signal is communicated for the purpose of logging-on the detonator. Otherwise a message is sent to the effect that the transmission of data is not possible. By this means, a corruption of the signals to be communicated as a result of the possibilities of error listed above is advantageously prevented from occurring.

The signals may be communicated optically, acoustically or mechanically, for example by vibrations, to the logger-on by the log-data communicator. At the same time, the logger assigned to the logger-on is switched to receiving by the log-on manager, in order that the corresponding data can be read in by the detonator to be connected. This addressing of the logger by the log-on manager can only be effected if it knows the identification code of the logger. Consequently it is possible that when a logger-on announces his presence the log-on manager can turn directly to the appropriate logger, in order that the latter can receive the signals of the log-data communicator assigned to the logger or alternatively the data pertaining to a detonator announcing its presence itself when logging on to the bus.

If the logger-on has now received the confirmation from the log-on manager that the detonator can be connected to the bus, it implements this connection and acknowledges the logging-on by the transmission of the identification code and possibly the position of the connected detonator if the ascertaining thereof—through the use of the GPS or the DGPS, for example—is possible.

If, by reason of the possibilities of error defined above, the logger now detects that the communicated data are incomplete or faulty, it can report the error immediately and, for example, communicate it visually on a display for the logger-on. As a result, faulty detonators or a faulty connection can be immediately detected.

As a result of the connecting of detonators in several detonating circuits to several buses it may happen that two or more loggers-on announce their presence to the log-on manager simultaneously. However, the log-on managers only allows one logging-on at a time, so that in each instance only one logger-on is offered the possibility of connecting a detonator and in each instance only the data pertaining to one detonator are transmitted to the logger assigned to it. The remaining loggers-on are informed by a signal that they are located, as it were, in a wait-condition, and enabling takes place only when the logging-on operation of a detonator that is already proceeding has been concluded. To this end, a wait-loop may be provided in the log-on manager, in which the respective loggers-on are arranged in temporal sequence according to the sequence of the incoming message, and the wait-position is optionally indicated to them.

Once a detonator has been successfully logged on to the bus by a logger-on, the logger acknowledges this to the log-data communicator with an acknowledging signal.

Thereafter the logger-on can notify the log-on manager of the successful logging-on of the detonator by virtue of a signal. The acknowledging signal of the logger may, however, also go directly to the log-on manager and may serve at the log-data communicator only as an indication of a successful logging-on. After this, the log-on manager can enable the logging-on of the next detonator for the following logger-on in the wait-loop. The logger-on who has just successfully carried out the connection of a detonator knows thereafter that he can register the connection of the following detonator.

The log-on management can also be implemented when the detonator announces its presence automatically to the logger when connecting to the bus. In this case, the logger-on firstly has to draw the attention of the log-on manager by means of the signal which he generates, to the fact that he intends to log a detonator on. Thereupon the log-on manager checks whether the logging-on operation of a detonator is already running at the same time. If this is the case, the logger to whose bus a detonator is to be logged on is barred to the reception of the data until such time as the logging-on operation of a preceding detonator to another logger has been concluded. After confirmation of the reception of the signals of the logged-on detonator by virtue of the acknowledging signal of the logger, either the logger-on can communicate the successful logging-on to the log-on manager or the signal can go directly to the log-on manager. The log-on manager thereafter sends an enabling signal to the logger to whose bus the detonator is to be logged on. If the detonator is then connected to the bus, it automatically sends its identification code to its logger which, in the case of an orderly reception of the signals, acknowledges the connection and stores the identification code, optionally with the geographical coordinates of the detonator, by way of address.

The process according to the invention provides the highest possible security in the course of the simultaneous logging-on of detonators in a detonating system with several detonating circuits and therefore with several loggers.

The log-on manager is suitable, moreover, for the purpose of coordinating the communication of the delay-times from the blaster to the individual detonators via the loggers. Since this transmission of data can likewise be impeded and disrupted by the possibilities of damage, described above, to the detonators or detonating lines, it is advantageous if each detonator is addressed individually. In this case the loggers and the blaster must have an address, in order that they can he addressed by the log-on manager. The log-on manager then allows the transmission of data that is to be addressed from the blaster only to the logger, and from there only to the detonators, and bars the remaining loggers. Once the transmission of data from the blaster to the respective logger and from there to the detonators has been concluded, the blaster can indicate the end of the transmission of data by means of a signal to the log-on manager. Similarly, the respective logger can report to the log-on manager the fact that the reception of the delay-time data by the detonators has taken place and the programming of the individual detonators has been concluded. On the basis of these signals the log-on manager can switch off the preceding logger and switch the following logger to receiving. The method according to the invention guarantees that, in the course of the transmission of signals after the connecting of the detonators and also in the course of the subsequent programming of the delay-times, the transmission of signals of one detonator or logger is not disrupted by the transmission of signals of another detonator or logger and that errors in the transmission are immediately detected and can be assigned to the respective transmitter or receiver, to the detonator or to the logger.

BRIEF DESCRIPTION OF THE DRAWING

The invention will be elucidated in more detail on the basis of an exemplifying embodiment.

DETAILED DESCRIPTION OF THE INVENTION

Figure 1:
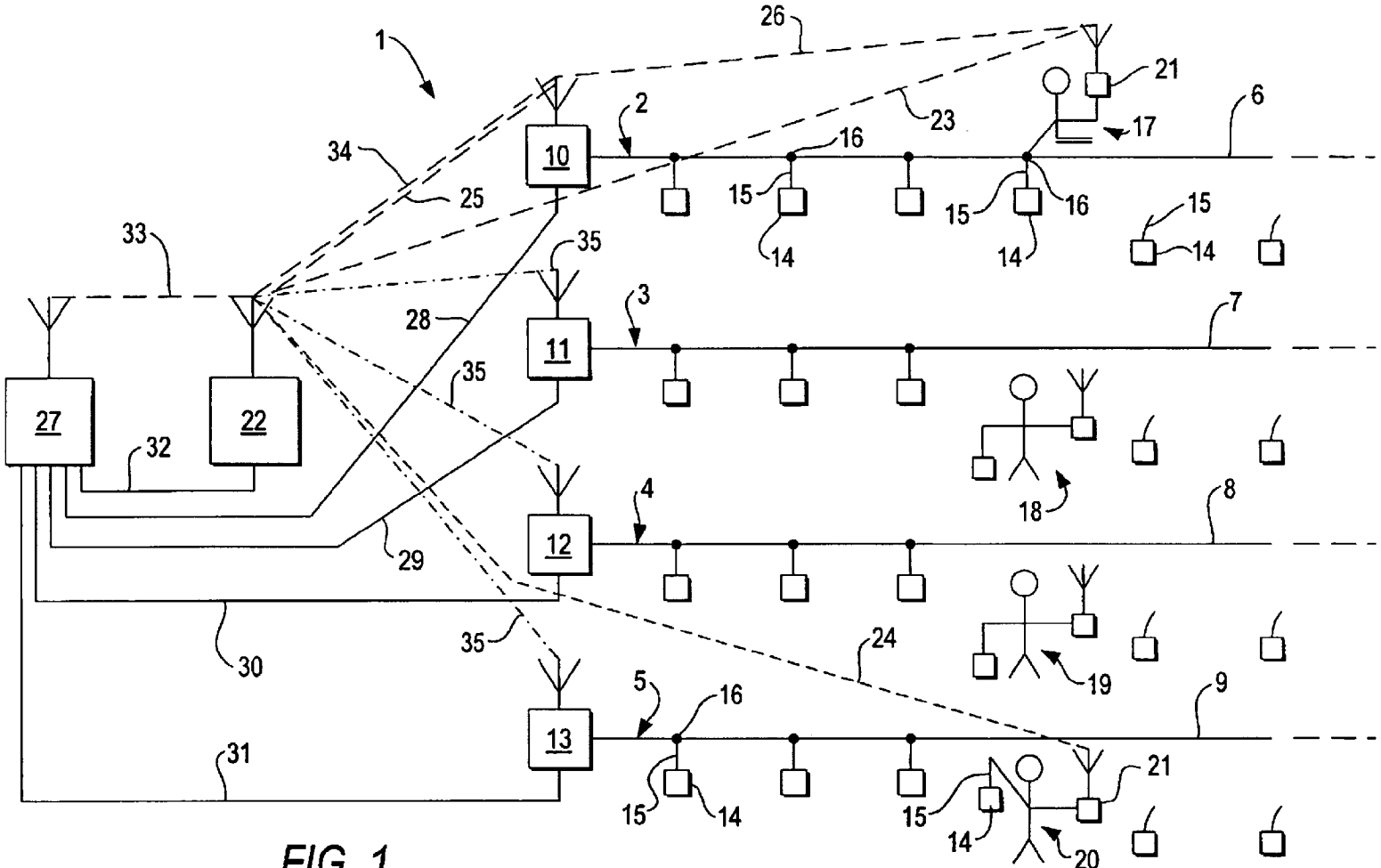
FIG. 1 is a view of a preferred embodiment of the invention.

The attached representation shows a detonating system 1 with four separate detonating circuits 2 to 5. Each of the detonating circuits 2 to 5 consists of a bus 6 to 9 which in each case starts from a logger 10 to 13 and to which the detonators 14 with their detonating line 15 are connected—that is to say, are logged on—at the connection-point 16. A person, a logger-on 17 to 20, in each of the four detonating circuits 2 to 5, is busy logging detonators on to the respective buses 6 to 9. The logger-on 17 is just in the process of logging a detonator 14, with its detonating line 16, on to the bus 6 of the detonating circuit 2 at a connection-point 16. The logger-on 20 wishes to proceed similarly at the same time.

Each of the loggers-on 17 to 20 has a transceiver, a log-data communicator 21, which has its own identification code. These log-data communicators 21 are suitable for bidirectional contact both with the respective loggers 10 to 13 and with the log-on manager 22.

In the present exemplifying embodiment, the transmission of data would be endangered in the case of a shunt of the detonators if there might be a simultaneous connection of detonators 14 by the logger-on 17 and the logger-on 20. In order to avoid this, both the logger-on 17 and the logger-on 20 have registered with the log-on manager 22 via their log-data communicators 21 by specifying their respective identification code. The log-on manager 22 can assign the loggers-on to the respective logger on the basis of the identification code of the respective log-data communication 21. In this way the logger-on 17 is assigned to the logger 10, and the logger-on 20 is assigned to the logger 13.

In the present exemplifying embodiment the logger-on 17 has, as symbolized by the radio contact 23, announced his presence to the log-on manager 22 before the logger-on 20, whose radio contact is symbolized by the dashed line 24, so that the log-on manager 22 switches the logger 10 on via the radio contact 25 which is indicated and allows the logger-on 17 to connect a detonator 14 ahead of the logger-on 20. After the log-on manager 22 has given the logger-on 17 the permission for logging the detonator 14 on at the connection-point 16, this logger-on communicates to the logger on the identification code of the detonator 14 and optionally the position of the borehole, in the present case by means of the log-data communicator 21, likewise by radio, to the logger 10. This transmission of data is symbolized by the radio contact 26. Once the data pertaining to the detonator have been communicated to the logger 10, the latter reports the orderly reception of the data to the log-data communicator 21 of the logger-on 17 via the radio link 26 which is indicated. Said logger-on 17 thereupon acknowledges the successfully accomplished logging-on operation by means of a signal to the log-on manager 22 via the radio link 23. Thereupon, the message is sent via the radio contact 24 which is indicated to the log-data communicator 21 of the logger-on 20 with the enabling notification for the purpose of logging the detonator 14, which has been held in readiness, on to the bus 9. Once the detonator has been successfully connected to the bus 9 by the logger-on 20, he acknowledges this connection by means of a radio signal to the log-on manager 22, so that the latter can pass on the enabling to another logger-on with a view to logging a detonator on.

Once all the detonators 14 that are ready have finally been logged on to the respective buses 6 to 9 of the detonating circuits 2 to 5, the programming of the detonators with respect to their time-delay is effected from the detonating device or from the tripping apparatus, the so-called blaster 27. The latter may be linked to the respective loggers 10 to 13 via lines 28 to 31. However, although not represented here, a radio link may exist between the blaster 27 and the respective loggers. Moreover, a link exists, via a line 32 or via a radio link 33 which is indicated, between the blaster 27 and the log-on manager 22. The log-on manager 22 is equipped for the purpose of switching the loggers 10 to 13 on and off separately in each instance if the delay-times in the detonators 14, for example, are to be stored by the blaster 27 in the respective detonating circuits 2 to 5. To this end, firstly there is a communication from the blaster 27 to the log-on manager 22 as to which of the loggers 10 to 13 of the detonating circuits 2 to 5 is to be addressed. In the present exemplifying embodiment the log-on manager 22 has entered into-a connection with the logger 10 via the radio contact 34 which is indicated here and has switched it on for the reception of the data from the blaster 27, whereas the following loggers 11 to 13 are switched via the remaining radio contacts 35 in such a way that they cannot receive the data intended only for the logger 10. Only after communication of the data that are intended for the detonating circuit 2 do a switch-over to the following logger and a disabling of the preceding logger, which has already received the data, take place, and the barring of the loggers to which these data are likewise not directed is retained.

Only when all the data have been communicated from the blaster 27 to the respective detonating circuits 2 to 5 can the detonators be detonated by the blaster 27 via the respective loggers.

What is claimed is:

1. A method for connecting detonators to a detonating system comprising several detonating circuits in which a plurality of detonators are connected to respective buses which each start from a logger which is connected to a blaster assigned to all the loggers, by which the detonators are detonated in a predetermined temporal sequence on the basis of a detonation command, wherein a log-on manager is installed which is in bidirectional contact with the loggers, with the blaster and with log-data communicators of the loggers, which signal data pertaining to the detonators to the logger, wherein when logging the detonators on to the buses of the detonating circuits of the detonating system a logger-on, the person who connects with the detonators, announces his presence to the log-on manager, in that the log-on manager recognizes the logger-on from an identification code assigned to him and assigns him to the logger to whose bus the logger-on wishes to connect the detonators, in that the log-on manager checks whether a detonator is being connected and data are being transmitted at the time of reporting, in that, when no data are being transmitted, the logger assigned to the bus for communicating the data pertaining to the detonator to be connected is switched to receiving and wherein when another detonator is already being connected, the log-on manager sends a message to the log-data communicator to the effect that a transmission of data is not possible, in that the connection of the detonator to the assigned logger is only enabled when the transmission of data pertaining to the other detonator has been concluded and in that the data communicated from the detonators form the basis for the temporal sequence of the detonation of the individual detonators.

2. A method according to claim 1, wherein the logger-on announces his presence with his identification code, the log-on manager turns directly to the appropriate logger and, when it is not presently occupied by a transmission of data, switches it to receiving in respect of the signals of the log-data communicator assigned to the logger or alternatively in respect of the data pertaining to a detonator announcing its presence itself when logging-on to the bus.

3. A method according to claim 1, wherein the logger-on has received the confirmation from the log-on manager that he can connect the detonator to the bus, he implements the connection of the detonator and acknowledges the logging-on by the transmission of the identification code.

4. A method according to claim 3, wherein the position of a connected detonator in the detonating system is communicated to the log-on manager.

5. A method according to claim 1, wherein two or more loggers-on announce their presence to the log-on manager with a view to connecting detonators, the log-on manager arranges the messages according to the sequence of their input into a wait-loop, optionally indicates a wait-position and enables a log-on operation only when a preceding log-on operation of a detonator has been successfully concluded or the noting of the error message of a non-orderly connection has been confirmed.

6. A method according to claim 1 wherein the data that have been communicated in the course of logging on are incomplete or faulty, the logger reports the error to the log-data communicator and the error is signaled at the log-data communicator or is indicated on a display of the log-data communicator.

7. A method according to claim 1, wherein a detonator has been successfully logged on to a bus by a logger-on, the logger acknowledges this at the log-data communicator with an acknowledging signal and thereafter the logger-on communicates the successful logging-on to the log-on manager.

8. A method according to claim 1, wherein a detonator has been successfully logged on to a bus by a logger-on, the logger reports this directly to the log-on manager and a corresponding signal appears at the log-data communicator.

9. A method according to claim 1, wherein a communication of delay times from the blaster to the individual detonators via the loggers is coordinated by the log-on manager, by the blaster and the loggers, in addition to the individual detonators, also having an address allocated to them by the log-on manager for the purpose of individual addressing, in that the transmission of data is regulated by the log-on manager in such a way that at all times only one logger and, via the latter at all times, only one detonator is addressed by the bluster and the remaining loggers are disabled and in that, when the transmission of data from the blaster to the respective logger and from there in each instance to the detonators has been concluded, the logger reports in each instance the orderly reception of the data by the detonators to the log-on manager and in that, after conclusion of the programming of the detonators that are connected to a logger, said logger is switched off by the log-on manager and the following logger is switched to receiving.

10. A method according to claim 1, wherein the transmission of signals between the log-on manager and the log-data communicators is effected bidirectionally by means of radio technology.

11. A method according to claim 1, wherein the transmission of signals between the log-on manager and the loggers is effected bidirectionally by means of radio technology.

12. A method according to claim 1, wherein the transmission of signals between the log-on manager and the blaster is effected bidirectionally by means of radio technology.

13. A method according to claim 2, wherein the logger-on has received the confirmation from the log-on manager that he can connect the detonator to the bus, he implements the connection of the detonator and acknowledges the logging-on by the transmission of the identification code.

* * * * *